US005220142A

United States Patent [19]

LaMaire et al.

[11] Patent Number: 5,220,142

[45] Date of Patent: Jun. 15, 1993

[54] UNIFORM MICROWAVE HEATING

[75] Inventors: Susan J. LaMaire, Yorktown Heights; David A. Lewis, Carmel, both of N.Y.

[73] Assignee: International Business Machines Corporation, Armonk, N.Y.

[21] Appl. No.: 647,112

[22] Filed: Jan. 29, 1991

[51] Int. Cl.[5] ..... H05B 6/80

[52] U.S. Cl. ..... 219/10.55 F; 219/10.55 E; 219/10.55 R; 426/243

[58] Field of Search ..... 219/10.55 E, 10.55 R, 219/10.55 F, 10.55 M, 10.55 A; 426/107, 113, 234, 243; 427/41, 407.1, 407.2, 407.3

[56] References Cited

U.S. PATENT DOCUMENTS

| | | | |
|---|---|---|---|
| 2,714,070 | 7/1955 | Welch | 219/10.55 F |
| 3,941,967 | 3/1976 | Sumi et al. | 219/10.55 E |
| 3,974,354 | 8/1976 | Long | 219/10.55 E |
| 4,081,646 | 3/1978 | Goltsos | 219/10.55 E |
| 4,351,997 | 9/1982 | Mattisson et al. | 219/10.55 E |
| 4,775,770 | 10/1988 | Fritz | 219/10.55 M |
| 4,800,247 | 1/1989 | Schneider et al. | 219/10.55 E |
| 4,888,459 | 12/1989 | Keefer | 219/10.55 E |
| 4,921,723 | 5/1990 | Nichols et al. | 427/41 |
| 5,079,397 | 1/1992 | Keefer | 219/10.55 E |

OTHER PUBLICATIONS

Ser. No. 07/551,716 filed Jul. 11, 1990 by Cuomo et al.

*Primary Examiner*—Bruce A. Reynolds
*Assistant Examiner*—Tuan Vinh To
*Attorney, Agent, or Firm*—Daniel P. Morris; Alvin J. Riddles

[57] ABSTRACT

A control element positioned between an object being heated and a source of microwave radiation is employed to prevent a localized concentration of microwave energy resulting from a discontinuity in the object surface. Close control is provided for heating an object with a sensitive coating.

14 Claims, 1 Drawing Sheet

UNIFORM MICROWAVE HEATING

FIELD OF THE INVENTION

The invention is in the field of microwave heating and particularly relates to providing uniform heating of an object having a surface discontinuity.

BACKGROUND OF THE INVENTION

In microwave heating, an object of microwave responsive material is placed in a cavity within the microwave field that occurs in a frequency band of 300 Megahertz (MHz) to 100 Gigahertz (GHz). The microwave energy in the field couples into the material of the object and raises the temperature. The coupling of the microwave energy is influenced by the focusing of the energy and the position within the cavity. This produces differences in coupling which in turn results in localized temperature variations in objects with different materials and different shapes.

One way of compensating for differences in shape and density in an effort to improve temperature uniformity is shown in U.S. Pat. No. 4,351,997, wherein shielding portions of an object with microwave opaque material is employed. The shielding of a portion of an object, however, produces a temperature gradient in the object which in some situations may be undesirable.

One illustration of the precision involved in the application of microwave radiation to chemical and physical processes is shown in U.S. patent application Ser. No. 07/551,716 filed Jul. 11, 1990.

A need is developing in the art for techniques that will minimize temperature differences and permit control to closer specifications in microwave processing.

SUMMARY OF THE INVENTION

The invention provides a control element for use in microwave processing which provides improved temperature uniformity of an object that is being heated by microwave radiation. The control element is positioned in the cavity between the object being processed and the source of microwave energy including the cavity walls, and operates to thereby prevent a localized temperature gradient in the object.

DESCRIPTION OF THE INVENTION

In microwave apparatus, the object being heated is seldom in direct shape conformity with the source of microwave radiation including cavity walls. Where there are departures from conformity, microwave energy concentration can occur, which in turn produces a localized high temperature region.

Figure 1:
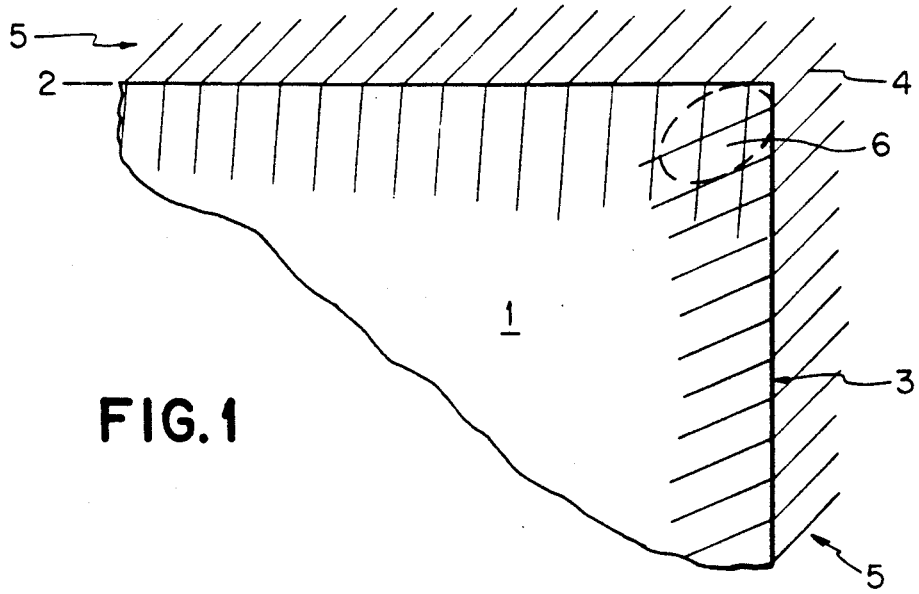
FIG. 1 is a schematic illustration of the region of energy concentration that occurs at a surface discontinuity of an object in a microwave field.

Referring to FIG. 1, a schematic illustration is provided of the region of energy concentration that occurs where there is a surface discontinuity of the object in a microwave field in a cavity. In FIG. 1, the object 1 has a surface discontinuity in the form of a corner where two sides 2 and 3 intersect. The object 1 is exposed to a microwave energy field 4, which emanates through space 5 and penetrates the object 1. The field 4 exhibits a change of direction at the surface of the object. This is illustrated by the field lines changing direction to more nearly perpendicular to the surface on penetration.

The change of direction of the field 4 where there is also a change of direction of the surface of the object 1, as illustrated by the corner produced by the intersection of sides 2 and 3, operates to concentrate the energy in a small area, shown as a dashed circle 6, producing a higher localized temperature in that area.

The localized higher temperature can be very detrimental especially where the temperatures in the processing are close to the maximum tolerable for the materials involved. As examples, localized temperature differences are undesirable in semiconductor chips, objects with coatings and bulk material processing. At high heating rates, temperature non-uniformity is a more serious problem because of reduced times for thermal equilibrium to take place.

If the microwave cavity were circular and the object were circular and both had a common center, there would be no localized energy concentration. In practice, however, microwave apparatus is required to accommodate a variety of possible object shapes to be heated. Surface discontinuities of the object 1 can cause a localized concentration of microwave energy such as the region of the dashed circle 6 in FIG. 1.

Figure 2:
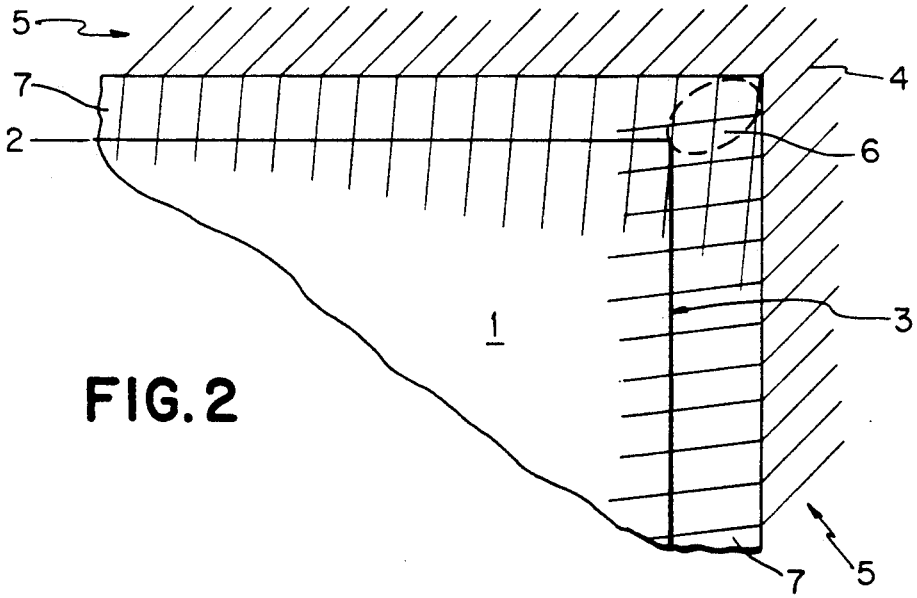
FIG. 2 is a schematic illustration of a portion of the control element of the invention where a surface discontinuity of the object is in a microwave field.

Referring to FIG. 2, in accordance with the invention, a control element 7 is provided that operates to confine the localized region 6 of microwave energy concentration to the control element 7 and thereby to prevent a localized higher temperature region from forming in the object 1 during heating.

In FIG. 2, the control element 7 is positioned between the object 1 and the source of radiation including the cavity walls, which may provide reflection or containment of the radiation 4. The control element 7 is essentially transparent to microwave energy so as not to seriously attenuate the energy at the object 1.

In a discontinuity situation, such as the essentially right angle discontinuity of the object 1 illustrated in FIG. 2, the presence of the control element 7 in the space 5 may simply move the localized energy concentration area 6 away from the object 1 and, in the case of this illustration, into the element 7.

The control element 7 of the invention may be provided with a dielectric constant that is different from that of the object 1. The dielectric constant of the element 7 is considered to essentially provide a bending of microwave energy similar in effect to that observed for light as it moves from one medium to another. The dielectric constant is generally designated as $\epsilon'$. In a perfect vacuum, it is 1.00 and for air it is slightly higher. Materials have higher values ranging from 2.08 for polytetrafluoroethylene (TEFLON TM) type polymers, other polymers are about 4.5 and ceramics are about 5 to 11.

The dielectric constant of the control element 7 can be greater than that of the object 1. Where the dielectric constant is greater, the localized energy concentration area 6, at a discontinuity of the surface of the object 1, moves away from the surface of the object 1. Where the dielectric constant of the control element 7 is lower than that of the object 1, the discontinuity produced energy concentration area 6 moves deeper into the object 1.

It will be apparent to one skilled in the art, in the light of the principles set forth, that those principles may be applied to many variations in object shapes and field orientation situations. In microwave apparatus construction, there is generally a tradeoff between having a construction that will couple a maximum amount of energy uniformly into an object and having a construction that will accommodate a large variety of object sizes and shapes, including the periphery of an object containing boat. The invention is useful in single and multimode microwave apparatus. The control element of the invention assists in that tradeoff through reducing localized concentrations of energy by providing an energy concentration defocusing member that surrounds the object 1 in the field 4.

BEST MODE OF CARRYING OUT THE INVENTION

The invention is of particular value in a situation where an object is equipped with a coating that has different properties with respect to the object.

Figure 3:
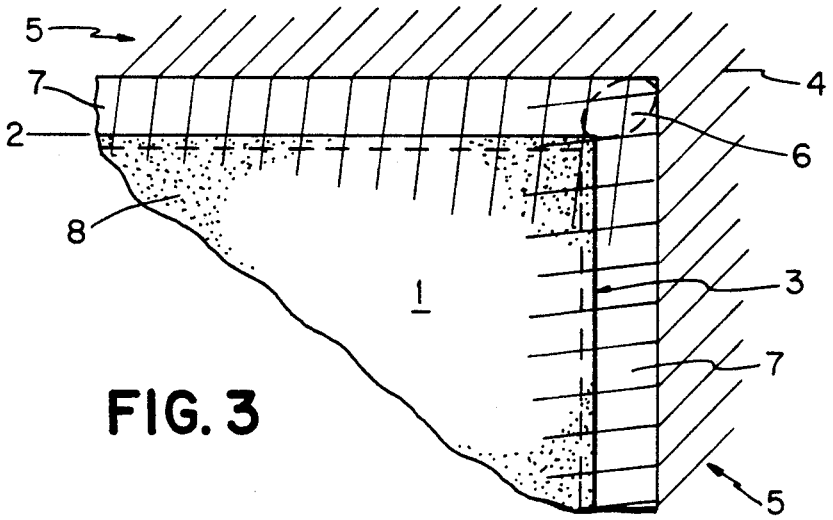
FIG. 3 is a schematic illustration of a portion of the preferred embodiment of the invention, wherein an object with an essentially square surface discontinuity and with a coating is positioned in the control element of the invention within a microwave field.

Referring to FIG. 3, a schematic illustration is provided of the corner of an object 1 of a glass ceramic material with metal features on the surface and in the bulk thereof. The object 1 is coated with a polymer film of polyimide material 8. The polymer film 8 requires, in the polymerization and curing processing, a temperature so close to the temperature at which the material 8 begins to have the properties degrade that a concentration of microwave energy at the discontinuity produced by the intersection of sides 2 and 3 would cause the polymer material 8 to be damaged in this region.

In accordance with the invention, a control element 7 is placed between the object 1 and the microwave field 4, at least everywhere where there is a surface discontinuity in the object 1. For a ¼ inch deep object 1, the control element 7 is of a machinable ceramic, known in the industry as MACOR TM approximately ¼ inches thick and 1 inch wide and with a dielectric constant $\epsilon'$ of 11. With the control element 7, films 8 can be processed at the full range of microwave frequencies, including the standard commercial frequency of 2.45 GHz providing better temperature uniformity.

What has been described is the providing of a control element positioned between the object and the source of a microwave radiation control localized microwave energy concentration where there is a discontinuity in object surface.

Having thus described our invention, what we claim as new and desire to secure by Letters Patent is:

1. In microwave heating apparatus, said apparatus including a cavity for enclosing a workpiece object, said cavity having a border through which radiation from a source produces a microwave field in said cavity, an improvement comprising:

a microwave responsive workpiece having a surface positioned in said cavity within said border, and, an energy concentration control element for prevention of locallized heating in a region of said surface of said workpiece, said energy concentration control element being interposed in said cavity between at least a portion of said surface of said workpiece and said border of said cavity, said energy concentration control element being of microwave transparent material.

2. The improvement of claim 1 wherein said element is positioned at least at each discontinuity of the surface of said object.

3. The improvement of claim 2 wherein said element surrounds said object.

4. The improvement of claim 3 wherein said element has a different dielectric constant from said object.

5. The improvement of claim 4 wherein said dielectric constant is higher than that of said object.

6. The improvement of claim 5 wherein said object has a coating.

7. The improvement of claim 6 wherein said object is glass ceramic with a polyimide coating, said element is a machinable ceramic with a dielectric constant of approximately 11 and a frequency of said microwave radiation is 2.45 GHz.

8. In microwave heating apparatus of a type wherein a microwave responsive object is subjected to a microwave energy field within a border, an improvement for prevention of localized heating comprising:

an element positioned between said object and said border at least at each surface discontinuity of said object, said element being of essentially microwave transparent material, and surrounding said object.

9. The improvement of claim 8 wherein said element has a different dielectric constant than that of said object.

10. The improvement of claim 9 wherein the dielectric constant of said element is higher than that of said object.

11. The improvement of claim 10 wherein said object has a coating.

12. The improvement of claim 11 wherein said object is glass ceramic and said coating is polyimide.

13. The improvement of claim 12 wherein said element is of machinable ceramic with a dielectric constant of approximately 11.

14. The improvement of claim 13 wherein microwave energy field at a frequency of 2.45 GHz is employed.

* * * * *